US008482470B2

(12) United States Patent
Abe

(10) Patent No.: US 8,482,470 B2
(45) Date of Patent: Jul. 9, 2013

(54) ELECTRIC DEVICE WITH AN ANTENNA DEVICE AND A SOLAR PANEL

(75) Inventor: Kazuaki Abe, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 242 days.

(21) Appl. No.: 13/014,274

(22) Filed: Jan. 26, 2011

(65) Prior Publication Data

US 2011/0187609 A1 Aug. 4, 2011

(30) Foreign Application Priority Data

Jan. 29, 2010 (JP) ..... 2010-018081

(51) Int. Cl.
*H01Q 1/12* (2006.01)

(52) U.S. Cl.
USPC ..... 343/718; 343/700 MS

(58) Field of Classification Search
USPC ..... 343/702, 700 MS, 718
See application file for complete search history.

(56) References Cited

U.S. PATENT DOCUMENTS

2008/0055177 A1* 3/2008 Dixon ..... 343/787
2012/0105288 A1* 5/2012 Abe ..... 343/702

FOREIGN PATENT DOCUMENTS

JP 08-213819 8/1996
JP 2000-165128 6/2000
JP 2001-289970 10/2001
JP 2005-274359 10/2005

OTHER PUBLICATIONS

Japanese Office Action for Japanese Application No. 2010-018081 mailed on Aug. 21, 2012.
Japanese Office Action for Japanese Application No. 2010-018081 mailed on Feb. 28, 2012.

* cited by examiner

*Primary Examiner* — Hoanganh Le
(74) *Attorney, Agent, or Firm* — Turocy & Watson, LLP

(57) ABSTRACT

An electronic apparatus includes an antenna device, a solar panel disposed on a front side of the antenna device and a circuit board disposed on a back side of the antenna device. The antenna device includes a plate-shaped dielectric, a plate-shaped radiation conductor disposed on a front side of the dielectric and a plate-shaped grounding conductor disposed on a back side of the dielectric. The dielectric has a through hole formed therein, and the solar panel has electrode pads on a back side thereof, electrode pads being exposed within the through hole in the dielectric. The circuit board has conductive patterns at positions thereon facing the electrode pads, and the conductive patterns are electrically connected to the electrode pads by electric connection members disposed within the through hole in the dielectric.

4 Claims, 10 Drawing Sheets

ELECTRIC DEVICE WITH AN ANTENNA DEVICE AND A SOLAR PANEL

CROSS-REFERENCE TO RELATED APPLICATIONS

This application is based upon and claims the benefit of priority from prior Japanese Patent Application No. 2010-018081, filed Jan. 29, 2010, the entire contents of which are incorporated herein by reference.

BACKGROUND OF THE INVENTION

1. Field of the Invention

The present invention relates to an electronic apparatus with an antenna device and a solar panel.

2. Description of the Related Art

Recently, onboard GPS (Global Positioning System) car navigation devices/portable handy GPS receivers have been widely put to practical use at inexpensive prices. In addition, miniaturization of the GPS receivers and their reception modules has been advanced by the technical advancement of digital communications and/or mobile device communications as well as miniaturization of electric parts due to curtailment and/or miniaturization of dielectric ceramic and/or ferroelectric materials. Furthermore, various portable subminiature GPS receivers and position detecting systems of a wristwatch type have been proposed. In this type of general use GPS receivers, a patch type flat antenna or a cylindrical helical antenna housed in a housing independent of the receiver or a patch type antenna housed in a housing of the receiver.

Japanese Patent Application KOKAI Publication No. 8-213819 discloses a wristwatch in which a watch case contains a patch type antenna device comprising a plate-shaped dielectric, a plate-shaped radiation conductor provided on a front surface of the dielectric, a plate-shaped grounding conductor provided on a back surface of the dielectric, and electric feeding members electrically connected to the radiation conductor. And, a frequency adjustment plate is further provided on the front surface of the radiation conductor through another dielectric.

Recently, from a standpoint of ecology, wristwatches which use electric power generated by a solar panel have a large percentage of the watches of all types. Japanese Patent Application KOKAI Publication No. 2001-289970 discloses a solar panel and a circuit board both of which are disposed in a back side of a watch glass of the wristwatch in a wristwatch case. In this wristwatch, the solar panel and the circuit board are electrically connected with each other by electric connection members such as coil springs at an outer periphery of the solar panel.

When a patch type antenna device and a solar panel are provided coaxially in a superimposing manner within a wristwatch case and the solar panel and a circuit board are electrically connected at the outer periphery of the solar panel with electrical connection members, as disclosed in the Japanese Patent Application KOKAI Publication No. 2001-289970, the solar panel must be larger in outer size than the antenna device. As a result, an outer periphery of the plate-shaped dielectric is covered with the solar panel.

In addition, if electrode pads that feed electric charges generated by the solar panel to the circuit board are provided at a position just near the outer periphery of the plate-shaped dielectric, the following big problems are caused. That is, the electrode pads of the solar panel would adversely influence a remarkably strong radiation electric field of the outer periphery of the plate-shaped dielectric, and lowers a reduction in an antenna gain.

It is therefore an object of the present invention to provide an electronic apparatus with an antenna device and a solar panel, which is capable of preventing a reduction in the antenna gain securely and easily.

BRIEF SUMMARY OF THE INVENTION

In order to achieve the above object, one aspect of the present invention provides an electronic apparatus comprising: an antenna device including a plate-shaped dielectric, a plate-shaped radiation conductor disposed on a front side of the dielectric and a plate-shaped grounding conductor disposed on a back side of the dielectric; a solar panel disposed on a front side of the antenna device; and a circuit board disposed on a back side of the antenna device. The plate-shaped dielectric has a through hole formed therein, the solar panel has electrode pads on a back side thereof, the electrode pads being exposed within the through hole in the dielectric, the circuit board has conductive patterns at positions thereon facing the electrode pads, and the electrode pads are electrically connected to the conductive patterns by electric connection members disposed within the through hole in the dielectric.

In the electronic apparatus according to the one aspect of the present invention, the electrode pads of the solar panel exposed within the through hole in the plate-shaped dielectric are electrically connected to the conductive patterns of the circuit board by the electric connection members disposed within the through hole in the plate-shaped dielectric. Therefore, no electrode pads for feeding electric charges generated by the solar panel to the circuit board are provided on the outer periphery of the solar panel opposing to the outer periphery of the plate-shaped dielectric. Thus, a radiation field of the electronic apparatus is difficult to be influenced by the electrode pads of the solar panel and a reduction in a gain of the electronic apparatus is securely and easily restrained.

Additional objects and advantages of the invention will be set force in the description which follows, and in part will be obvious from the description, or may be learned by practice of the invention. The objects and advantages of the invention may be realized and obtained by means of the instrumentalities and combinations particularly point out hereinafter.

BRIEF DESCRIPTION OF THE SEVERAL VIEWS OF THE DRAWINGS

The accompanying drawings, which are incorporated in and constitute a part of the specification, illustrate an embodiment of the present invention, and together with the general description given above and the detailed description of the embodiment given below, serve to explain the principles of the present invention.

DETAILED DESCRIPTION OF THE INVENTION

Referring to the accompanying drawings, a wristwatch as one of electronic apparatuses according to the present invention will be described. However, the present invention is not limited to this wristwatch but applicable to general electronic apparatuses with an antenna device and a solar panel.

Figure 1:
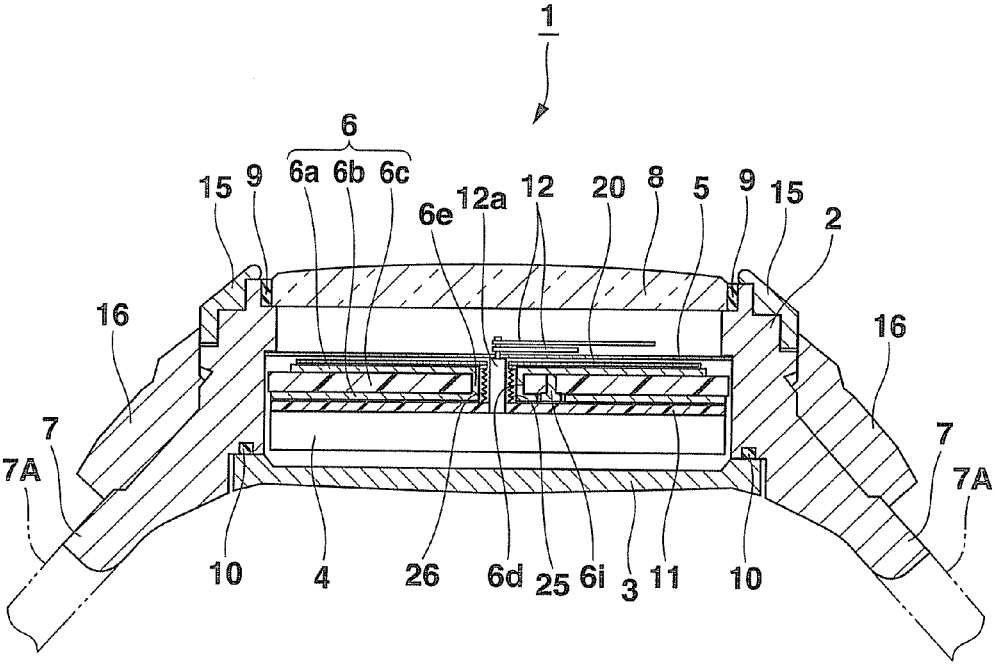
FIG. 1 is a schematic cross-sectional view of a wristwatch according to one embodiment of the present invention.

FIG. 1 is a schematic cross-sectional view of the wristwatch 1 of the embodiment. The wristwatch 1 comprises a hollow cylindrical metal case 2 made, for example, of stainless steel or titanium and a metal back cover 3 closing an opening at one end of the case 2 via a waterproof ring 10. The case 2 and the back cover 3 compose a housing of the wristwatch 1. A timepiece module 4, a circuit board 11, an antenna device 6, a solar panel 20 and a dial plate 5 are contained within the case in this order from the back cover 3. The antenna device 6 receives radio waves from a GPS (Global Positioning System). The solar panel 20 charges a secondary battery (not shown) mounted in the wristwatch 1 with electric charges generated by the solar panel 20.

A pair of band attachments 7 is provided at 12 and 6 o'clock positions on an outer periphery of the case 2, and a pair of wristbands 7A is attached thereto. A ring-like metal bezel 15 and a ring-like metal front cover 16 are fitted over a top of the case.

A transparent watch glass 8 is attached to an opening in the top of the case 2 through a gasket 9 so that the dial plate 5 disposed within the case 2 can be seen from the outside of the case 2.

The timepiece module 4 comprises an IC chip (not shown) on which various circuits are formed and a hand driving mechanism (not shown) which drives hands 12 including hour, minute and second hands over the dial plate 5. The IC chip comprises a control IC including a CPU which controls various elements of the timepiece module 4, a receiver circuit connected electrically to the antenna device 6 to receive, amplify and demodulate GPS radio waves and extract positional and time data contained in the GPS radio waves, and a time counter including an oscillator and counting a current time.

Figure 2:
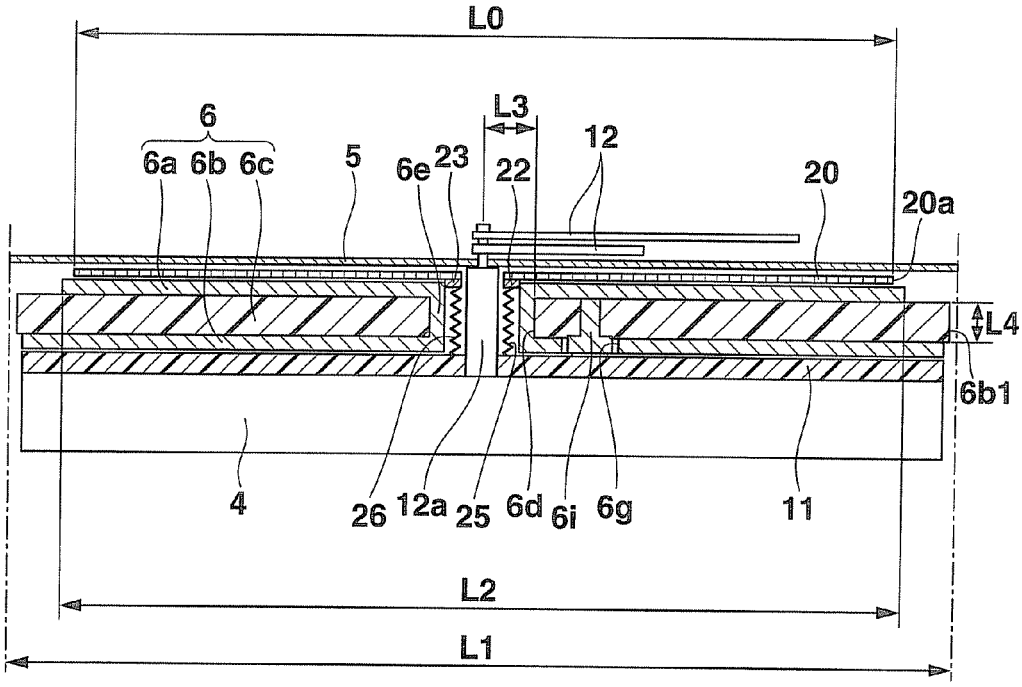
FIG. 2 is an enlarged cross-sectional view of a part of the wristwatch of FIG. 1, including an antenna device, a solar panel and some other components around them.

The control IC controls a display including the various elements of the timepiece module 4 to display a current position of the wristwatch, based on the positional data received by the receiver circuit, and controls the hand driving mechanism to set current time, based on the time data received by the receiver circuit. Another antenna device may be provided to obtain a current time data from a standard time radio wave without obtaining the time data from the GPS radio waves. In FIGS. 1 and 2, reference character 12*a* denotes a hand shaft which extends through the antenna device 6 and the solar panel 20.

On an upper surface of the circuit board 11, electrically conductive patterns 11*a* and 11*b* connected to various circuits including a power source circuit (not shown), the receiver circuit and the time counter are formed.

As shown in FIG. 2, the antenna device 6 is a flat antenna structure in which a plate-shaped dielectric 6*c* is sandwiched between a plate-shaped radiation conductor 6*a* and a plate-shaped grounding conductor 6*b*. Each of the plate-shaped radiation conductor 6*a* and the plate-shaped grounding conductor 6*b* is made, for example, of silver foil of 12 μm thickness. The plate-shaped dielectric 6*c* is made, for example, of a 13-layered ceramic lamination, each layer having 50 μm thickness.

A relative dielectric constant of the dielectric 6*c* is set to shorten the wavelength of the received radio waves. Without the plate-shaped dielectric, a diameter of the plate-shaped radiation conductor must be ½ of the wavelength of the received radio waves. In this case, for example, if the frequency of the radio wave received from the GPS satellite is 1.57542 GHz, the diameter of the plate-shaped radiation conductor 32*a* must be 95.2 mm. However, the plate-shaped radiation conductor 32*a* of this diameter is too big to be incorporated into the case 2. In this embodiment, therefore, the plate-shaped dielectric 6*c* is used and the relative dielectric constant of the dielectric 6*c* is set relatively high, so that the wavelength of the received radio waves is shortened.

A relationship between the shortened wavelength and the dielectric constant of the antenna device is displayed as follows.

That is, the electrically shortened wavelength is represented by $\lambda g=\lambda/\sqrt{\in e}$, where $\lambda$ is the wavelength of the received radio wave and $\in e$ is an effective dielectric constant of the antenna device. For example, when an inner diameter of the case 2 is about 30 mm, the relative dielectric constant of the dielectric is set to be about 10-30.

A common through hole 6*d* is formed in the center SA of each of the radiation conductor 6*a*, the dielectric 6*c* and the grounding conductor 6*b*. A diameter of the common through hole 6*d* is, for example, 2.5 mm. The radiation and grounding conductors 6*a* and 6*b* are electrically short-circuited by a short-circuiting conductor tube 6*e* fitted into an inner peripheral surface of the central through hole 6*d* and being as a short-circuiting conductor. The short-circuiting conductor tube 6*e* constitutes an electric connection member electrically connecting the radiation conductor 6*a* and the grounding conductor 6*b* with each other.

A pair of cuts 6*f* is formed at opposite positions on the outer periphery of the radiation conductor 6*a* to cause the antenna device 6 to function as a circular polarization wave antenna.

An electric feed pin 6*i* which has an electric feed land disposed within a through hole formed in the vicinity of the central hole 6*d* in the grounding conductor 6*b* to be electrically isolated from the grounding conductor 6*b* extends through the dielectric 6*c* and connects electrically to the radiation conductor 6*a*. Further, the feed pin 6*i* is electrically connected to a conductive pattern (not shown) formed on the circuit board 11 so that the feed land of the feed pin 6*i* is connected electrically to the receiver circuit. The grounding conductor 6*b* is grounded at a point (not shown) through a conductive pattern (not shown) formed on the circuit board 11. In FIG. 2, the land of the feed pin 6*i* disposed within the through hole of the grounding conductor 6*b* is electrically isolated from the grounding conductor 6*b*.

As shown in FIG. 2, in this embodiment, the outer size L0 of the solar panel 20 is 27 mm, the inner diameter L1 of the case 2 is 30 mm, the outer diameter L2 of the dielectric 6*c* is 29.5 mm, the radius L3 of the hole of the dielectric 6*c* is 1.25 mm, the thickness L4 of the dielectric 6*c* is 0.5 mm-1.5 mm, and its relative dielectric constant is 10-30. However, these dimensions and values are not limited to these described values.

The outer size L0 of the solar panel 20 is set to be smaller than the outer size L2 of the radiation conductor 6*a* so that the outer periphery 20*a* of the solar panel 20 does not project out from the outer periphery 6*a*1 of the radiation conductor 6*a*.

Figure 3A:
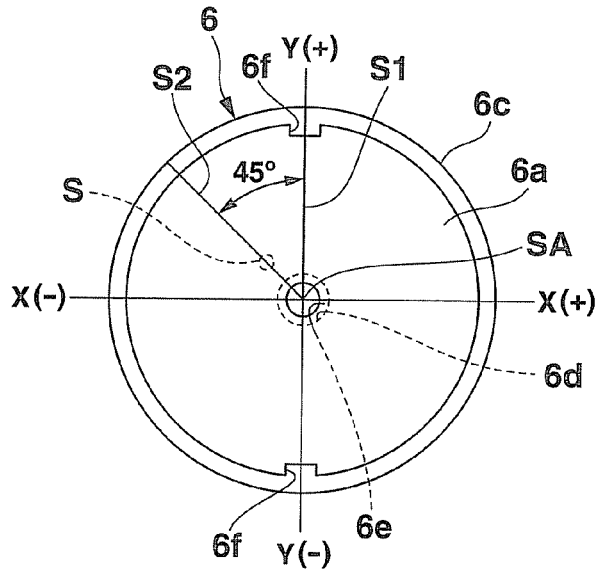
FIG. 3A is a plan view of the antenna device of FIG. 2.
Figure 3B:
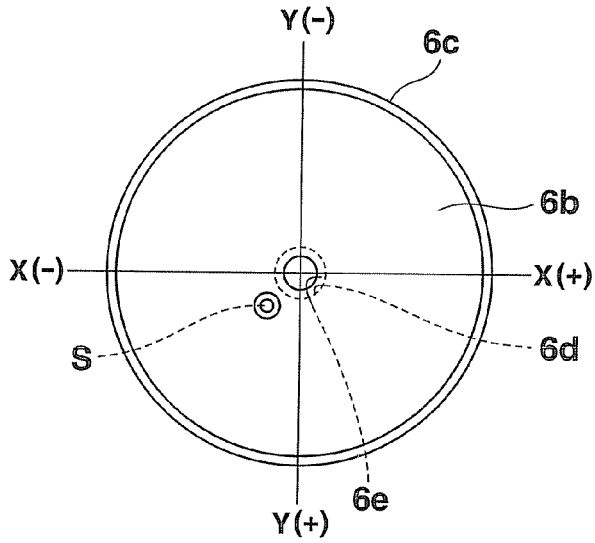
FIG. 3B is a bottom view of the antenna device of FIG. 2.
Figure 3C:
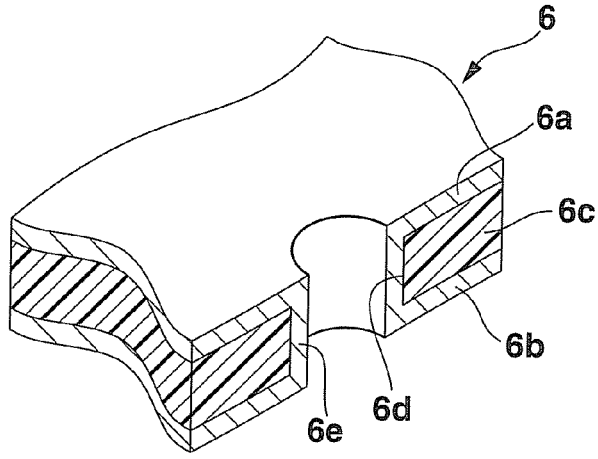
FIG. 3C is an enlarged fragmentary perspective view of the antenna device of FIG. 2.

Next, a setting location for an electric feeding point S of the feeding pin 6*i* will be described. FIG. 3A is a plan view of the antenna device 6 of this embodiment, FIG. 3B is a bottom view of the antenna device 6, and FIG. 3C is a perspective view of the antenna device 6.

The shape of each of the grounding conductor 6*b* and the dielectric 6*c* in the plan view is circular.

Since the GPS radio wave is a right circular polarization, in this embodiment, the feeding point S is set at a position where a line segment Y(+)-Y(−) connecting the two cuts 6*f* and a line segment SA-S connecting the center SA of the radiation conductor 6*a* and the feeding point S cross each other at 45 degrees in an area where X<0 and Y>0. Although in this embodiment, the feeding point S is set in the vicinity of the center SA of the radiation conductor 6*a*, the feeding point S may be provided at a position near to the outer periphery of the antenna device 6 in a 12 o'clock direction if the impedance is, for example, 50Ω.

As another method for receiving the right circular polarization, the feeding point S may be set at a position where the line segment Y(+)-Y(−) connecting the two cuts 6*f* and the line segment SA-S connecting the center SA of the radiation conductor 6*a* and the feeding point S cross each other at 45 degrees in an area where X>0 and Y<0.

In this respect, in order to receive a left circular polarization, the feeding position S is set at a position where the line segment Y(+)-Y(−) connecting the two cuts 6*f* and the line segment SA-S connecting the center SA of the radiation conductor 6*a* and the feeding point S cross each other at 45 degrees in an area where X>0 and Y>0 or in an area where X<0 and Y<0.

In this embodiment, a distance between the feeding position S and the center SA of the radiation conductor 6*a* is set to make the impedance, for example, 50 Ω, thereby performing an offset electric feeding. That is, the input impedance is adjusted at this feeding position.

The case 2 and the antenna device 6 which is contained in the case 2 may have similar polygonal shapes. In this case, when the antenna device 6 is disposed into the case 2, the respective corners of the antenna device 6 can be positioned so as to coincide with the associated corners of the case 2, thereby preventing the antenna device 6 from rotating relative to the case 2 after the antenna device 6 is disposed into the case 2.

Next, the reason why the through hole 6*c* is formed in the center position of the radiation conductor 6*a* and why the radiation conductor 6*a* and the grounding conductor 6*b* are electrically connected with each other by the short-circuiting tube 6*e* fitted in the through hole 6*d* will be described.

The antenna device of this embodiment is a patch type antenna. In a general patch type antenna, the voltage at the center of the radiation conductor is 0 volt. Thus, the antenna characteristic is not substantially influenced only by electrically connecting the radiation conductor 6*a* and the grounding conductor 6*b* with each other at the center position.

The applicant discovered that when the through hole 6*d* is formed in the radiation conductor 6*a* at the center thereof, and the radiation conductor 6*a* and the grounding conductor 6*b* were electrically connected to and short-circuited with each other through the short-circuiting tube 6*e* fitted in the through hole 6*d*, the short-circuiting tube 6*e* functioned as an antenna element contributing to improve a gain of the antenna so that an area or volume which receives the radio wave is increased and the antenna gain also increased by the short-circuiting tube 6*e* in comparison with a case in which the through hole is formed in the radiation conductor 6*a* but the short-circuiting tube 6*e* is not provided within the through hole 6*d*.

Thus, the through hole 6*d* is formed in the radiation conductor 6*a* at the center thereof, and the radiation conductor 6*a* and the grounding conductor 6*b* are electrically connected with each other by the short-circuiting tube 6*e* provided along the inner periphery of the through hole 6*d*.

By providing the short-circuiting tube 6*e* of this structure within the through hole 6*d*, a bad influence from the solar panel 20 can be decreased and a reduction in the gain of the antenna can be restricted in comparison with the case in which the short-circuiting tube 6*e* is not provided within the through hole 6*d* of the radiation conductor 6*a*.

The reason for this is that, by providing the short-circuiting tube 6*e* within the through hole 6*d*, an electric potential difference between the upper and lower ends of the through hole 6*d* is reduced to zero and hence an electric field intensity within the through hole 6*d* is remarkably reduced.

Figure 4A:
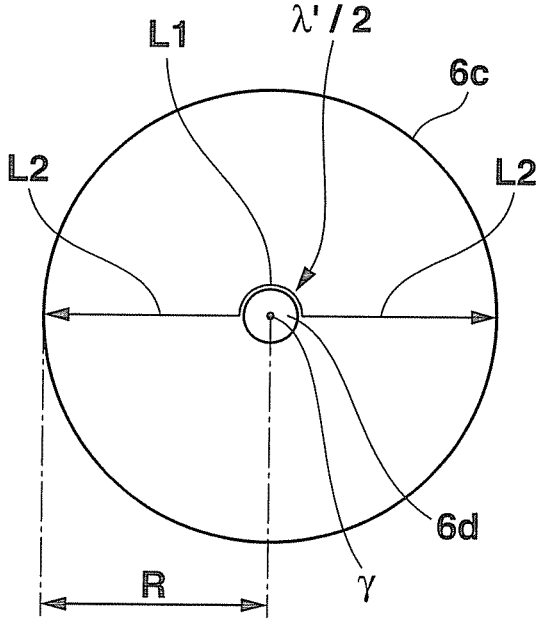
FIG. 4A is a plan view of an antenna device as a comparative example.
Figure 4B:
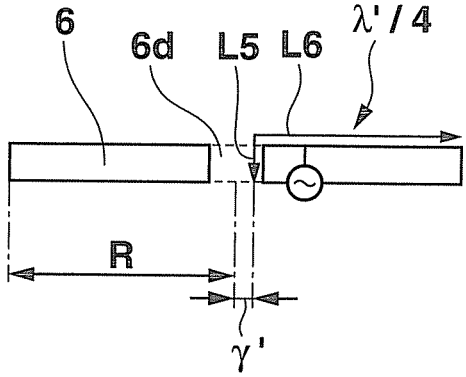
FIG. 4B is a side view of the antenna device of FIG. 2.

FIG. 4A is a plan view of the antenna device where the radiation conductor and the grounding conductor are not electrically short-circuited with each other by the short-circuiting tube 6*e* in the through hole. FIG. 4B is a side view of the antenna device according to the embodiment, where the radiation conductor and the grounding conductor are electrically short-circuited with each other by the short-circuiting tube 6*e* in the through hole.

An explanation will be done with reference to both of these figures. In a case of the antenna device without the short-circuiting tube as shown in FIG. 4A, the outer shape of the dielectric 6*c* is designed to correspond the sum of an arc length L1 of ½ of the inner periphery of the circular through hole 6*d* and two times of a difference L2 between a radius R of the dielectric 6*c* and a radius r of the through hole 6*d* to ½ of the wavelength λ' of the radio wave within the dielectric 6*c*.

Since an electric current detours along the inner periphery of the circular through hole 6*d*, the overall path through of which the current flows increases in comparison with an antenna device where a through hole is not provided. Thus, the outer size of the antenna device is reduced in comparison with the antenna device where the through hole is not provided.

In the antenna device shown in FIG. 4B and according to the present embodiment, the short-circuiting tube 6*e* is fitted into inner periphery of the through hole 6*d*. And, the outer shape of the dielectric 6*c* is designed to correspond the sum of a height L5 of the short-circuiting tube 6*e* and a difference between the radius R of the radiation conductor 6*a* and the inner radius r' of the circuiting tube to ¼ of the wavelength λ'. Thus, with the antenna device of this embodiment, an area or volume by which a radio wave is received is increased and its gain of the antenna is increased in comparison with the antenna device where the short-circuiting tube is not provided as shown in FIG. 4A.

The antenna device 6 as described above can obtain the following advantages.

Since the through hole 6*d* is provided in the center SA of the antenna device and the radiation conductor 6*a* and the grounding conductor 6*b* are electrically connected with each other through the short-circuiting tube 6*e* fitted into the inner periphery of the through hole 6*d*, the short-circuiting tube 6*e* functions as an antenna element and increases the area or volume for receiving the radio wave and thus increases the gain of the antenna in comparison with the antenna device where the short-circuiting tube is not provided.

Further, even when the antenna device 6 is disposed within the metal case 2, a decrease in the gain of the antenna due to the metal case 2 is reduced by causing the opening in the dial plate 5 to have the directivity of the antenna device.

Figure 5:
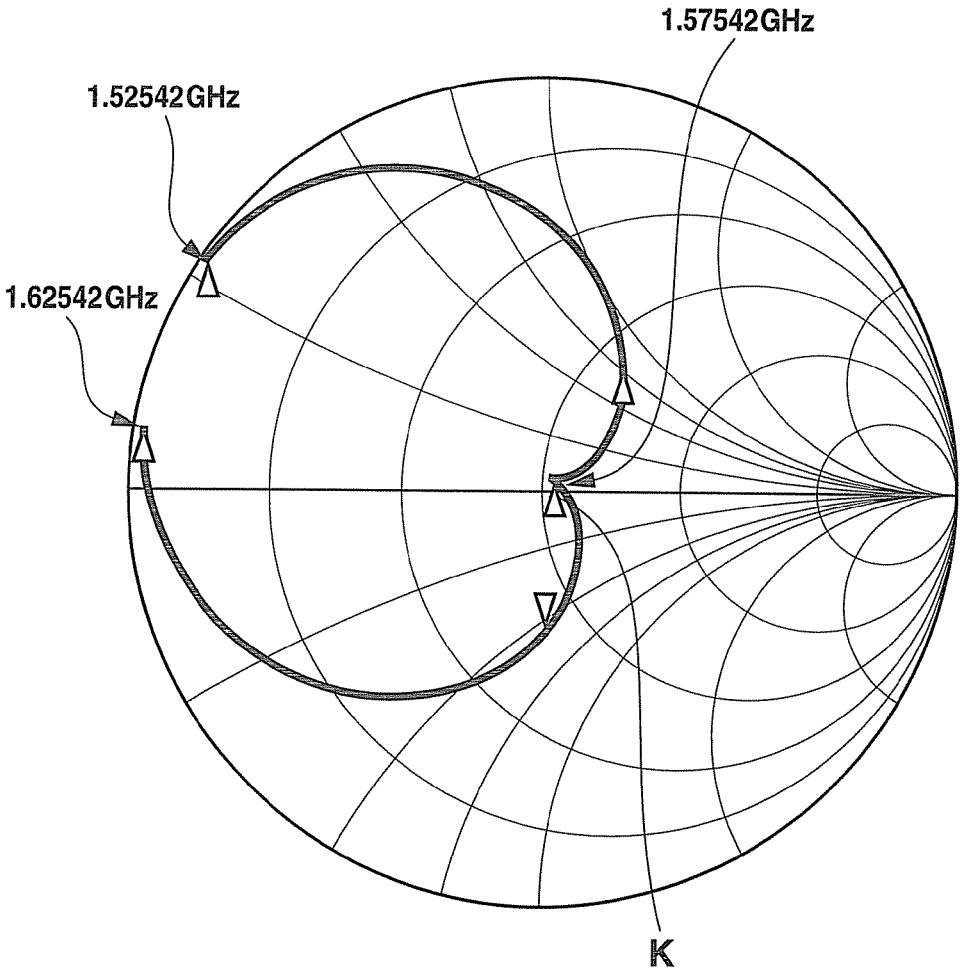
FIG. 5 shows a Smith chart for comparing and explaining measured input impedances of the antenna device of the embodiment.

Results of measurement of an input impedance of the antenna device according to this embodiment are shown in a Smith chart of FIG. 5. Since this antenna device is an antenna having a circular polarization characteristic, the depicted locus of the input impedance has a recess indicated by K in this figure, and an impedance matching with a center frequency (1.57542 GHz) is performed at the recess.

Figure 6:
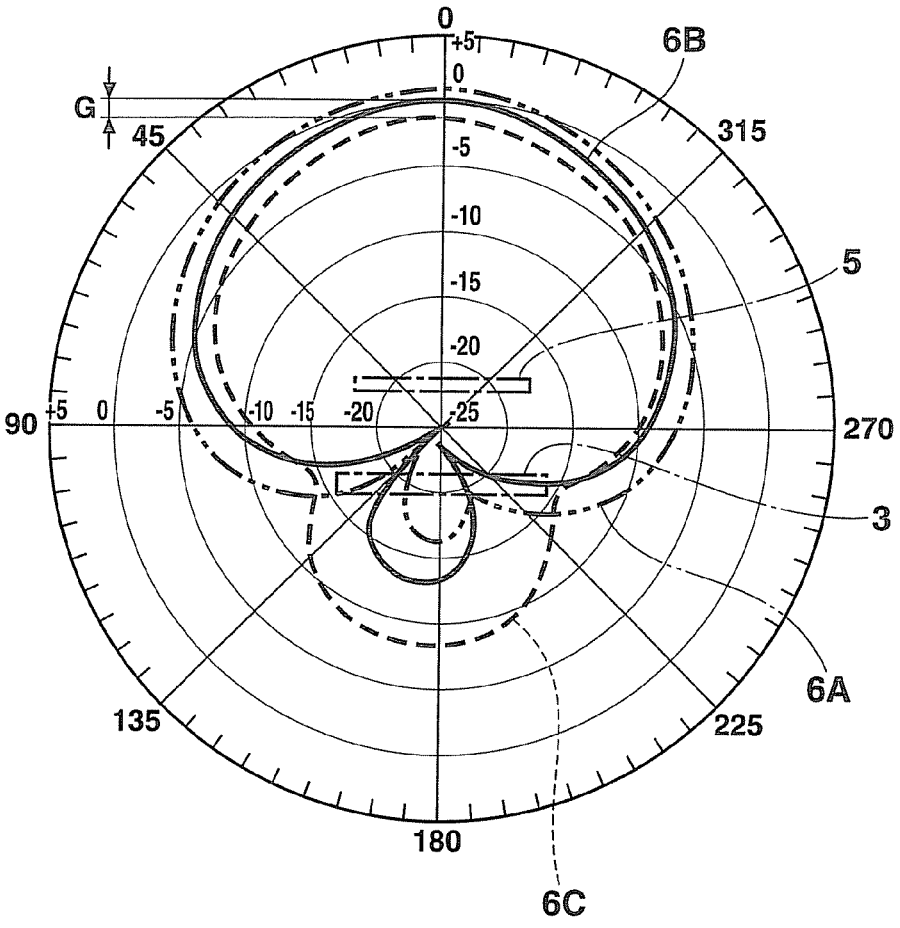
FIG. 6 shows a directional gain pattern obtained by the antenna device of the embodiment when the antenna device received a right circular polarization.

FIG. 6 shows three directional gain characteristic curves 6A, 6B and 6C which are obtained by three different patch type antenna devices when these antenna devices receive the same right circular polarization. In these figures, each of numerals along the outer periphery of the outermost circle denotes an angle (degrees) from a top direction (zero degree) of the patch antenna device (in a direction directing toward watch glass 8), and each of numerals in the radius direction denotes a gain (dB).

In FIG. 6, the directional gain characteristic curve 6A indicated by a two-dots chain line shows the directional gain characteristic curve obtained by the naked patch antenna device 6 which is not contained in the metal watch case 2 with the metal back cover 3.

The directional gain characteristic curve 6B indicated by a solid line shows the directional gain characteristic curve obtained by the patch antenna device 6 in which the radiation conductor 6*a* and the grounding conductor 6*b* are connected electrically with each other by the short-circuiting tube 6*e* and which is contained in the metal watch case 2 with the metal back cover 3.

The directional gain characteristic curve 6C indicated by a broken line shows the directional gain characteristic curve obtained by the antenna device 6 in which the radiation conductor 6*a* and the grounding conductor 6*b* are not connected electrically with each other by the short-circuiting tube 6*e* and which is contained in the above described metal watch case 2 with the above described metal back cover 3.

In this figure, each of the directional gain characteristic curves is shown when a maximum gain in a case that the input impedance is measured while the antenna device 6 with the short-circuiting tube of this embodiment is contained within the metal watch case 2 with the metal back cover 3 is used as a standard of 0 dB.

As will be obvious from the characteristic curve 6B shown in this figure, with the antenna device 6 according to this embodiment, that is, the antenna device 6 of this embodiment contained in the metal case 2 with the metal back cover 3 and having the structure in which the radiation conductor 6*a* and the grounding conductor 6*b* are connected electrically with each other by the short-circuiting tube 6*e*, even in the state where the antenna device is contained within the metal case 2 with the metal back cover 3, the directional gain characteristic curve 6B has a directivity toward the dial plate (in the upward direction in FIG. 6) and hence the gain is not so much reduced by the metal case 2.

Compared the directional gain characteristic curve 6B of the solid line and the directional gain characteristic curve 6C of the broken line with each other, the gain characteristic in the directional gain characteristic curve 6B is increased by a gain G than the gain characteristic in the directional gain characteristic curve 6C in a range between a direction which directs toward a face in which the grounding conductor 6*b* is provided and a direction which directs toward a face in which the radiation conductor 6*a* is provided (in the direction of 0 degree in FIG. 6), thereby improving the sensitivity of radio wave reception.

Figure 7:
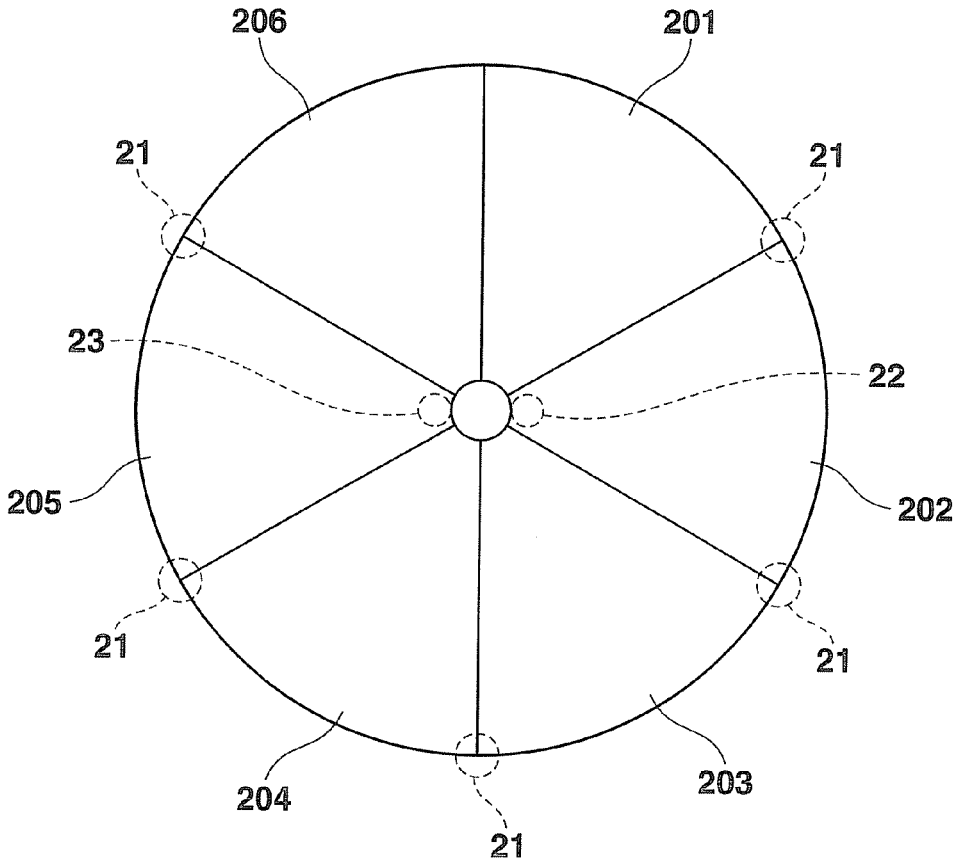
FIG. 7 is a plan view of the solar panel of the wristwatch of FIG. 1.

As shown in FIG. 7, the solar panel 20 is constituted by six flat solar cells 200. The number of the solar cells 200 is not limited to six. In the following descriptions, the six solar cells 200 will be indicated by reference numerals 201-206 when there is need to make explanation about them being easier. Each of the solar cells 200 has a sector shape in its plan view. Specifically, each of the solar cells 200 comprises two straight sides with a central angle of 60 degree between them, one arc shaped side connecting the ends of the two sides where the two sides are approached to each other, and another arc shaped side connecting the other ends of the two sides where the two sides are separated from each other. When these solar cells are arranged side by side in one plane, these solar cells as a whole form the circular solar panel 20 with a hole 21 at its center position. In this case, the longer arcs of the six solar cells 200 are continuously arranged and form the outer periphery of the solar panel 20, the shorter arcs of the six solar cells 200 are also continuously arranged and form the hole 20*a* at the center of the solar panel 20, and the six solar cells 200 are electrically connected with each other.

Figure 8:
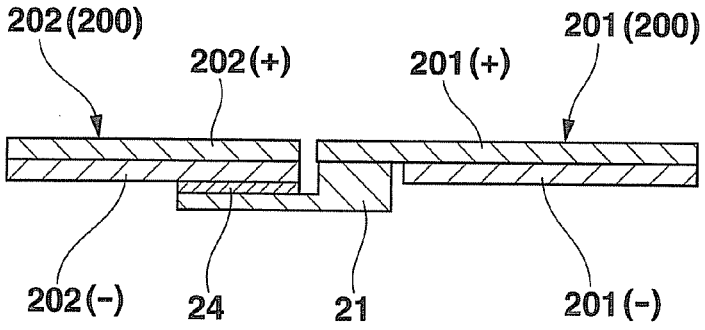
FIG. 8 shows an electrical connection structure for adjacent cells of the solar panel of FIG. 7.

The solar cells 201-206 of the solar panel 20 are electrically connected in this order in series. Particularly, an electrical connection between the solar cells 201 and 202, that between the solar cells 202 and 203, that between the solar cells 203 and 204, that between the solar cells 204 and 205, and that between the solar cells 205 and 206 are performed by electric connectors 21 provided at the outer periphery of the solar panel 20 (FIG. 8).

Next, a connection structure by the electric connector 21 will be explained with reference to FIG. 8. This connection structure is provided at each of portions L, each encircled by a broken line in FIG. 7, that is provided between adjacent cells on the outer periphery of the solar panel 20. In the following, the connection structure between the solar cells 201 and 202 will be described as an example.

The solar cell 201 and the solar cell 202 are overlapped with each other at a front side plus electrode of the former and at a back side minus electrode of the latter. Designating the front side plus electrode of the solar cell 201 with 201 (+) and designating a back side minus electrode thereof with 201 (−). Further, designating a front side plus electrode of the solar cell 202 with 202 (+) and designating the back side minus electrode thereof with 202 (−). A part of the minus electrode 201 (−) of the solar cell 201 is cut out, and one end portion of the electric connector 21 electrically connects to the plus electrode 201 (+) of the solar cell 201 in the cut out. The other end portion of the electric connector 21 is lead in the back side of the solar panel 20 and is electrically connected to the minus electrode 202 (−). In FIG. 7, a reference numeral 24 designates an electrically conductive adhesive.

With the same connection structure, the solar cell 202 and the solar cell 203, the solar cell 203 and the solar cell 204, the solar cell 204 and the solar cell 205, and the solar cell 205 and the solar cell 206 are electrically connected to each other, respectively.

Then, a structure of each of the electrode pads 22 and 23 will be explained with reference to FIG. 9. These electrode pads 22 and 23 are provided in the vicinity of the central hole 20*a* in the solar panel 20.

Figure 9A:
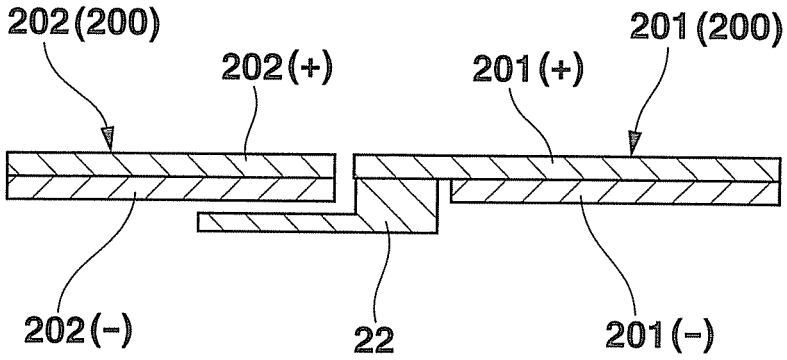
FIG. 9A shows a plus side of electrode pads of an electrode structure of the solar panel of FIG. 7.
Figure 9B:
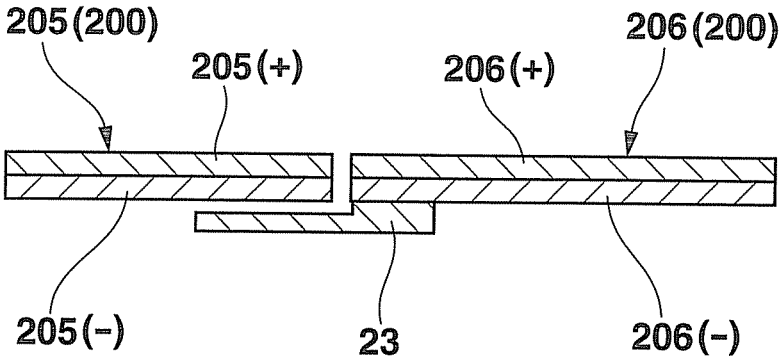
FIG. 9B shows a minus side of electrode pads of the electrode structure of the solar panel of FIG. 7.

FIG. 9A shows the electrode pad 22 of the solar cell 201, and FIG. 9B shows the electrode pad 23 of the solar cell 202.

As shown in FIG. 9A, one end of the electrode pad 22 is electrically connected to the plus electrode 201 (+) of the solar cell 201, and the other end of the electrode pad 22 extends below the minus electrode 202 (−) of the solar cell 202. The electrode pad 22 and the minus electrode 202 (−) of the solar cell 202 are isolated from each other so as not to contact directly with each other.

As shown in FIG. 9B, one end of the electrode pad 23 is electrically connected to the minus electrode 206 (−) of the solar cell 206, and the other end of the electrode pad 23 extends below the minus electrode 205 (−) of the solar cell 205. The electrode pad 23 and the minus electrode 205 (−) of the solar cell 205 are isolated from each other so as not to contact directly with each other.

Figure 10:
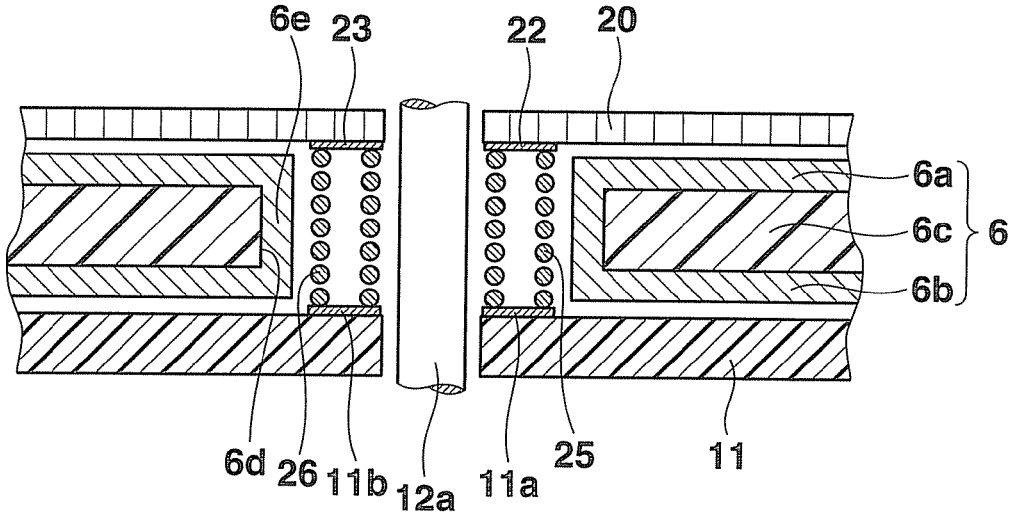
FIG. 10 is a cross-sectional view of a center part of the antenna device, solar panel and circuit board of FIG. 2.

Next, an electrical connection structure between the solar panel 20 and the circuit board 11 will be explained with reference to FIG. 10.

A pad portion of the electrode pad 22 extending below the minus electrode 202 (−) of the solar cell 202 and a pad portion of the electrode pad 23 extending below the minus electrode 205 (−) of the solar cell 205 are exposed within the hole 6*d* in the antenna device 6. Conductive patterns 11*a* and 11*b* corresponding to the electrode pads 22 and 23 on the circuit board 11 disposed in a back side (lower side) of the antenna device 6 are also exposed within the hole 6*d* in the antenna device 6. The electrode pads 22 and 23 and the conductive patterns 11*a* and 11*b* corresponding thereto are electrically connected to each other by electrically connection members 25, 26 each having a shape of a coil spring, respectively. The electrically connection members 25 and 26 are electrically isolated from the short-circuiting tube 6*e* of the antenna device 6. Thus, the antenna device 6 is difficult to be influenced adversely by the electrode pads 22 and 23, thereby preventing a reduction in the gain of the antenna easily and securely.

In contrast thereto, in the conventional antenna device where the electrodes provided on the outer periphery of the plate-shaped dielectric are close to the electrodes provided on the outer periphery of the solar panel, the remarkably strong electric radiation field on the outer periphery of the plate-shaped dielectric is influenced by the conductive pattern on the outer periphery of the solar panel. Thus, the radiation electric field of the antenna device is easily influenced by the conductive pattern. That is, the radiation electric field of the antenna device is changed by the conductive pattern. When the electric radiation field of the antenna device changes, a distribution of currents flowing in antenna elements changes and hence the impedance of the antenna changes, thereby causing a reduction in the gain of the antenna. And, this is a big problem.

Figure 11:
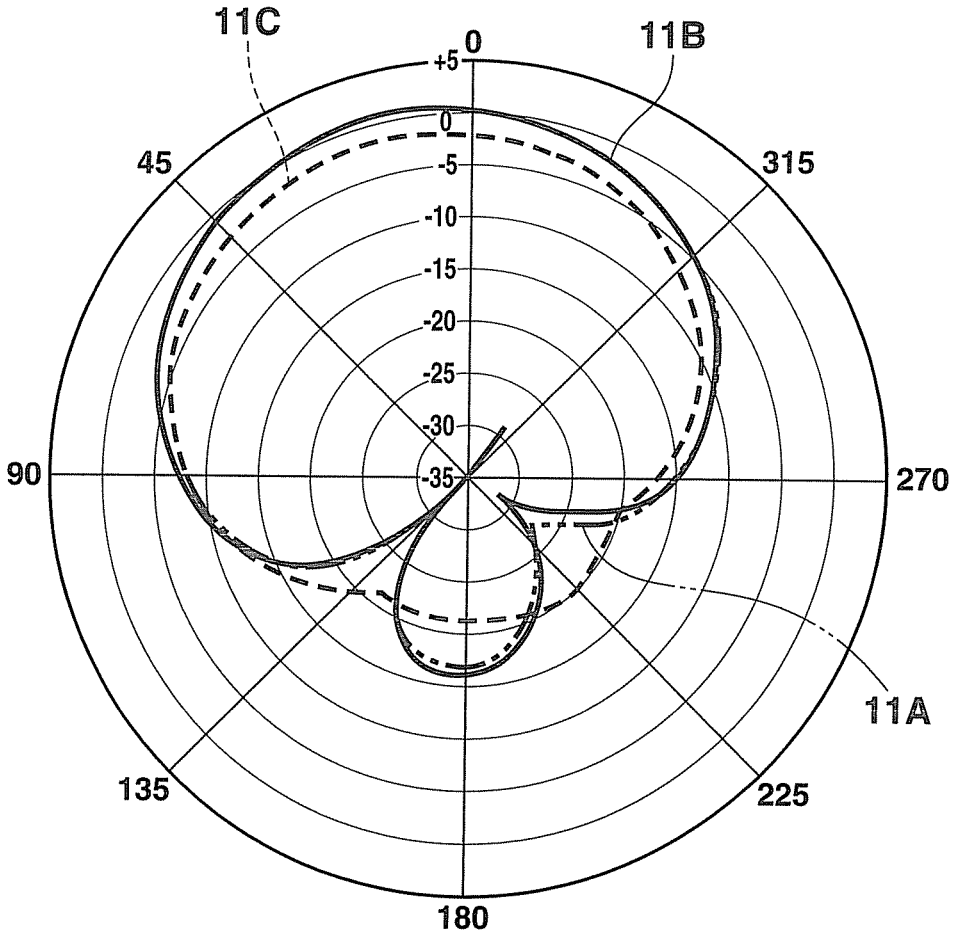
FIG. 11 shows three different directional gain patterns obtained by the antenna device in three different states when the antenna device received the same right circular polarization.

FIG. 11 shows three directional gain characteristic curves shown by a patch antenna device in three different states when the antenna device receives the same right circular polarization. The antenna device 6 has the same structure as that of the embodiment, and the solar panel at the center of which the hole is formed is used. And, the antenna device 6 is disposed within the metal watch case. Then, the solar panel is selectively disposed above the antenna device 6 but the solar panel is not electrically connected to the circuit board. This is because the selective disposition of the solar panel is to check an influence on the antenna device 6 by the size and presence of the solar panel.

In this figure, each of numerals arranged along the outer periphery of the outermost circle is an angle (degree) from a top direction of the antenna device (in a direction of the watch glass 8) when the top direction is as 0 degree, and each of numerals arranged in the radial direction of the outermost circle shows a gain (dB). Characteristic curves 11A, 11B, and 11C show a radiation characteristic of the antenna device 6 including the radiation conductor plate 6*a*, etc., that is, a directional characteristic of the gain.

In this figure, the directional gain characteristic curve 11A shown by a two-dots chain line is that of the antenna device 6 with no solar panel 20.

The directional gain characteristic curve 11B shown by a solid line is that of the antenna device 6 above which the solar panel 20 is disposed and in which the solar panel 20 is smaller than the outer diameter of the radiation conductor 6*a* and the solar panel 20 does not project out from the outer edge of the radiation conductor 6*a*.

Further, the directional gain characteristic curve 11C shown by a broken line is that of the antenna device 6 above which the solar panel 20 is disposed and in which the solar panel 20 is larger than the outer diameter of the radiation conductor 6*a* and the solar panel 20 projects out from the outer edge of the radiation conductor 6*a*.

In this figure, each directional gain characteristic curve uses the maximum gain obtained by the antenna device 6 above which the solar panel 20 is not disposed as a standard of 0 dB.

As obvious from the directional gain characteristic curves 11A and 11B, each of the directional gain characteristic curve 11A of the antenna device 6 without the solar panel and the directional gain characteristic curve 11B of the antenna device 6 above which the solar panel 20 is disposed and in which the diameter of the solar panel 20 is smaller than the outer shape of the radiation conductor 6*a* so as not to project out the solar panel 20 from the outer edge of the radiation conductor 6*a* is a circular polarization having a directivity in the side of the dial plate (in the upper direction side in FIG. 11), and reduction of the gain by the influence of the solar panel 20 is small. That is, both of the directional gain characteristic curves 11A and 11B are substantially the same with each other in the side of the dial plate.

As obvious from the directional gain characteristic curves 11A and 11C, the directional gain characteristic curve 11C of the antenna device 6 above which the solar panel 20 is disposed and in which the diameter of the solar panel 20 is larger than the outer shape of the radiation conductor 6*a* so as to project out the solar panel 20 from the outer edge of the radiation conductor 6*a* is a circular polarization having a directivity in the side of the dial plate (in the upper direction side in FIG. 11), but reduction of the gain by the influence of the solar panel 20 is large as 2 dB.

By the way, in a case that a solar cell having no hole at the center thereof and being smaller than the outer shape of the radiation conductor 6*a* is disposed above the antenna device 6, the maximum gain is −0.1 dB (within the measurement error).

As described above, when using the antenna device 6 above which the solar panel 20 is disposed and in which the solar panel 20 is smaller than the outer shape of the radiation conductor 6*a* and the solar panel 20 does not project out from the outer edge of the radiation conductor 6*a*, a reduction in the gain by an influence of the solar panel is restrained. In addition, the electrically conductive coil springs 25 and 26 disposed within the hole 6*a* in the antenna device 6 electrically connect the solar panel 20 and the circuit board 11. Thus, the reduction in the gain due to the solar panel 20 is further restrained.

As described above, in a case of the electronic apparatus of this embodiment, the electronic timepiece 1 comprises the antenna device 6 including the plate-shaped dielectric 6*c*, the plate-shaped radiation conductor 6*a* disposed on the front side of the plate-shaped dielectric and the plate-shaped grounding conductor 6*b* disposed on the back side of the plate-shaped dielectric; the solar panel 20 disposed on the front side of the antenna device; and the circuit board 11 disposed on the back side of the antenna device. Further, the antenna device comprises the through hole 6*d* formed in the center of the plate-shaped dielectric 6*c*, the solar panel 20 has the electrode pads 22, 23 on the back side thereof to expose the electrode pads 22, 23 within the through hole; the circuit board 11 has the conductive patterns 11*a*, 11*b* at positions facing the electrode pads 22, 23; and the electrode pads 22, 23 are electrically connected to the conductive patterns 11*a*, 11*b*, by the electric connection members 25, 26 disposed within the through hole.

The outer size L0 of the solar panel 20 is formed to be smaller than the outer size L2 of the radiation conductor 6*a*, and the outer edge 6*b*1 does not project out from the outer edge 6*b*1 of the radiation conductor 6*a*.

The electronic apparatus further comprises the hollow cylindrical metal case 2 which contains the antenna device and the solar panel, a watch glass 8 being the transparent member and covering the front opening located in the front surface of the metal case, and the back cover 3 being the metal member and closing the back opening located in the back surface of the metal case.

Further, the metal case contains the dial plate 5 disposed in the front side of the solar panel and the hand shaft 12*a* to which the hands 12 are attached so that the hands 12 are driven by the hand shaft to be rotated in the front side of the dial plate, the shaft extending through the through hole in the dielectric and through the circuit board, the antenna device and the solar panel.

Further, the antenna device has an electric connection member short-circuited tube 6*e* provided on the inner peripheral surface of the through hole, electrically connecting the radiation conductor and the grounding conductor with each other to short-circuit the radiation conductor and the grounding conductor.

Although the embodiment of this invention is explained above, this invention is not limited to this embodiment and its modifications, and various modifications are possible.

For example, although, in the above described embodiment, the short-circuiting tube 6*e* is provided in the hole 6*d*, the short-circuiting tube 6*e* may be not provided within the hole 6*d*.

Although, in the above described embodiment, the electrode pads 22 and 23 are provided in the space provided at the position of the center in the plate-shaped dielectric 6*c*, the electrode pads may be provided in a hole formed in the vicinity of the center space so as to be electrically connected to the conductive patterns 11*a* and 11*b* corresponding to the electrode pads 22 and 23 on the circuit board 11 by the electrically connection members 25 and 26.

Although, in the above described embodiment, both of the case 2 and the back cover 3 are made of metal, they may be made of plastic.

Although, in the above described embodiment, the wristwatch with the GPS reception function is explained, this invention is applicable to any other radio wave receiver including a mobile phone with the GPS reception function, a GPS only receiver, etc.

Although, in the above described embodiment, the electronic apparatus which receives the radio waves is explained, this invention is applicable to an electronic apparatus which transmit radio waves.

Additional advantages and modifications will readily occur to those skilled in the art. Therefore, the invention in its broader aspects is not limited to the specific details and representative embodiments shown and described, herein. Accordingly, various modifications may be made without departing from the spirit or scope of the general inventive concept as defined by the appended claims and their equivalents.

What is claimed is:

1. An electronic apparatus comprising:

a circular polarization wave antenna device including a circular plate-shaped dielectric having a through hole formed therein at a center thereof or in the vicinity of the center thereof, a circular plate-shaped radiation conductor disposed on a front side surface of the dielectric, a circular plate-shaped grounding conductor disposed on a back side surface of the dielectric and an electric feed member electrically connected to the radiation conductor and electrically isolated from the grounding conductor;

a solar panel disposed on a front side of the circular polarization wave antenna device;

a circuit board disposed on a back side of the circular polarization wave antenna device and electrically connected to the electric feed member;

electrode pads provided on a back side of the solar panel and being exposed within the through hole in the dielectric;

conductive patterns provided at positions on the circuit board, the positions facing the electrode pads;

electric connection members disposed within the through hole in the dielectric and electrically connecting the electrode pads to the conductive patterns;

a hollow cylindrical metal case having front and back openings and containing the solar panel, the circular polarization wave antenna device and the circuit board;

a transparent member covering the front opening end of the metal case; and a metal cover closing the back opening end of the metal case.

2. The electronic apparatus of claim 1, wherein an outer size of the solar panel is smaller than an outer size of the radiation conductor, and an outer peripheral edge of the solar panel is within an outer peripheral edge of the radiation conductor.

3. The electronic apparatus of claim 1, wherein the metal case further contains a dial plate disposed in a front side of the solar panel and a timepiece module disposed in a back side of the circuit board, the timepiece module having a hand shaft extending through the circuit board, the through hole in the dielectric of the circular polarization wave antenna device and the solar panel and being provided with hands in a front side of the dial plate, the hands being driven by the shaft to be rotated in the front side of the dial plate.

4. The electronic apparatus of claim 1, wherein the circular polarization wave antenna device has a short-circuiting electric connection member provided on an inner peripheral surface of the through hole, electrically connecting the radiation conductor and the grounding conductor with each other, and short-circuiting the radiation conductor and the grounding conductor.

* * * * *